United States Patent [19]

Kirby

[11] Patent Number: 4,966,497

[45] Date of Patent: Oct. 30, 1990

[54] METHOD OF SETTING, RESETTING AND PROTECTING POLES IN THE GROUND WITH FOAM POLYURETHANE RESINS

[75] Inventor: Norman R. Kirby, Alvin, Tex.

[73] Assignee: Utility Structural Systems, Houston, Tex.

[21] Appl. No.: 400,645

[22] Filed: Aug. 30, 1989

[51] Int. Cl.[5] ..... E02D 5/26

[52] U.S. Cl. ..... 405/232; 405/303

[58] Field of Search ..... 405/232, 263, 303; 52/169.13; 528/75, 78, 85, 65, 48

[56] References Cited

U.S. PATENT DOCUMENTS

| | | | |
|---|---|---|---|
| 2,915,496 | 12/1959 | Swart et al. | 524/710 |
| 3,344,871 | 10/1967 | Goodman | 175/19 |
| 3,403,520 | 10/1968 | Goodman | 405/303 |
| 3,564,859 | 2/1971 | Goodman | 405/303 |
| 3,611,736 | 10/1971 | Goodman | 52/169.13 X |
| 3,706,680 | 12/1972 | Booth | 521/170 |
| 3,830,760 | 8/1974 | Bengtson | 521/112 |
| 3,846,347 | 11/1974 | Satterly | 521/159 |
| 3,968,657 | 7/1976 | Hannay | 405/232 |
| 4,248,975 | 2/1981 | Satterly | 521/110 |
| 4,299,751 | 11/1981 | Born | 528/85 X |
| 4,314,962 | 2/1982 | Wollensak et al. | 264/328.6 |
| 4,424,333 | 1/1984 | O'Connor | 528/75 |
| 4,439,577 | 3/1984 | O'Connor et al. | 524/425 |

OTHER PUBLICATIONS

Polyiso Board Foamers Scramble for F-11 Alternatives, Plastics Today, Jan. 7, 1989.

Flexible Foamers to Drop F-11 by Year 2000, Plastics Today, Mar. 18, 1969.

Urethane Manufacturing Prepares for Life Without CFC's, Robert Burns, Plastics Technology, Dec. 1988.

Silicone Rubber Foam Poised to Challenge Polyurethane, Plastics Technology, Technology News, Nov. 1988.

How Urethane Foamers will Learn to Live Without CFC's, Plastics Technology, Aug. 1988.

News Watch, Mike Berins, Plastic World, Sep. 1988.

New Urethane Foam System Needs No CFC's, Technology Newsfocus Plastics Technology, Sep. 1988.

Flexible PUR Foam Technology Reduces Need for CFC's, Technology Newsfocus, Plastics Technology, Jan. 1989.

Structural Plastics Makers to Review New Technology, Plastics Today, Mar. 4, 1989.

*Primary Examiner*—Dennis L. Taylor

*Attorney, Agent, or Firm*—Fulbright & Jaworski

[57] ABSTRACT

An improvement in the known method of setting or resetting poles in the ground or ground line treatment or ecapsulation of pole treatment chemicals in the ground and enhancement of the strength, density, ratio of foam polyurethane resins formed in-situ from polyisocyanate and resin reactive therewith. Ground water and detrimental natural soil chemicals are often encountered in pole setting and affect polyurethane foam formation by undesirably reacting with the polyurethane to give a foam of insufficient density and strength. This improvement comprises adding to a non-volitale water-immiscible material, catalyst and a non-halogenated blowing agent by the normal polyurethane components. This composition decreases the cost per unit of the polyurethane foam. There is also the method for the addition to the polyurethane composition of various repellant materials and preservative agents for the pole.

3 Claims, No Drawings

METHOD OF SETTING, RESETTING AND PROTECTING POLES IN THE GROUND WITH FOAM POLYURETHANE RESINS

FIELD OF THE INVENTION

The present invention relates generally to a method of setting or resetting poles in the ground using foam polyurethane resin. It more particularly relates to the improvement of setting poles in a water environment using a non-volatile water-immiscible material without a halogenated hydrocarbon blowing agent.

BACKGROUND OF THE INVENTION

This invention is an improvement in known methods of setting, or resetting poles in the ground, ground line treatment of poles or encapsulation of pole treatment chemicals and enhancement of the strength to density ratio, of foam polyurethane resins formed in-situ from polyisocyanate and resin reactive therein. Ground water and detrimental natural soil chemicals are often encountered in pole setting and these affect polyurethane foam formation by undesirably reacting with the polyisocyanate to give a foam of insufficient density and strength.

The present invention is an improvement in the invention disclosed in U.S. Pat. Nos. 3,968,657 to Hannay, 3,564,859 to Goodman and 3,403,520 to Goodman which describe related methods for resetting poles with foam plastic. The entire disclosures of U.S. Pat. Nos. 3,968,657, 3,564,859 and 3,403,520 are incorporated herein by reference.

In brief, U.S. Pat. No. 3,403,520 describes a method of setting pole forms in the ground by making a hole which is only slightly larger than the butt of the pole to be placed in the hole, placing the pole in the hole in the desired position, partially filling the hole with a reaction mixture of a synthetic resin and a blowing agent and permitting the reaction to complete so as to expand the foam and resin into all the space between the pole and the sides of the hole. The expanded resin adheres to and seals to the end of the pole protecting it from moisture, chemicals and rodents and sets the pole in the hole. The expanding resin fills all the voids, surfaces, crevices and notches, both in the sides and bottom of the hole, as well as in the butt of the pole itself.

U.S. Pat. No. 3,564,859 describes a procedure for straightening and refilling the hole. It utilizes the same method as U.S. Pat. No. 3,403,520 for producing foam and for filling the voids resulting when the existing installed pole has been canted or tilted.

U.S. Pat. No. 3,968,657 was an improvement upon these methods by the addition of a non-volitale water-immiscible material to the mixture so that the reaction can take place in the presence of ground water.

SUMMARY OF THE INVENTION

An object of the present invention is an improved method for setting and resetting poles in soil with foaming polyurethane without using a halogenated compound as a blowing agent.

Thus, in accomplishing the foregoing object, there is provided in accordance with one aspect of the present invention is the method of setting poles, resetting poles, ground line treatment of poles, encapsulation of pole treatment chemicals or the like with a foamed polyurethane composition wherein the improvement comprises the steps of in-situ formation of said composition by combining polyisocyanate, an organic active hydrogen containing component, a liquid water-immiscible component in an amount effective to allow formation of a film of sufficient strength for holding the pole in the presence of water, a catalyst and a non-ionic surfactant, said composition having a density of about 4 to 5 pounds per cubic feet and compression of at least about 75 PSI.

In a preferred embodiment the composition is formed by combining about 30–50% 4, 4′ diphenylmethane diisocyanate, about 5–30% petroleum hydrocarbon ESCOPOL A-135, about 20–35% of amine phenolic or polyether polyol or combination of both, about 5–8% aromatic solvent Exxon SC150, up to about 1% silicone glycolcopolymer, less than 1% water, and up to about 1% aminophenol catalyst.

In a more preferred embodiment the composition is composed of 4, 4″ diphenylmethal diisocyanate of about 40.2%, a petroleum hydrocarbon ESCOPOL A-135 of about 18.2%, an amine phenolic or polyether polyol or combination of both of about 33%, an aromatic solvent Exxon SC150 of about 6.8%, a silicone glycolcopolymer of about 0.7%, water of up to about 0.8%, aminophenol catalyst of about 0.2%.

The other and further objects, features and advantages will be apparent from the following description of the presently preferred embodiments of the invention given for the purpose of disclosure.

DETAILED DESCRIPTION

It is readily apparent to one skilled in the art that various substitutions and modifications may be made to the invention disclosed herein without departing from the scope and spirit of the invention.

This invention provides a novel solution to the problem of forming a polyurethane form in-situ in the presence of large amounts of water without the use of a halogenated hydrocarbon as a blowing agent. This method provides an improvement in the known methods for setting and resetting poles in the ground with a polyurethane foam where ground water is encountered and without using the normal blowing agents which are usually composed of halogens and/or water.

This improvement is a significant advancement in the method of forming polyurethane foams and significantly affects the environment by the ability to form the foams without the use of halogenated compounds, more particularly without using chlorofluorcarbons.

When making foams, for the setting of poles or resetting of poles, it is important that the foam have certain characteristics and densities.

The foam should have a density of about 4–5 pounds per cubic feet and a compression of at least about 75 pounds per square inch. When mixtures do not contain halogenated fluorocarbons, it is a major problem to form this composition and to obtain sufficient density to strength ratios. Although U.S. Pat. 3,968,657 teaches that blowing agents responsible for foam formation can be any of the agents known in the art and that water is preferred, it is also known that in most applications some of the water will have to be replaced with a volatile halogenated hydrocarbon such as freon in order to obtain faster foam formation and to produce a foam of less density or increased tensile compression strength. The present application describes a method for forming a composition which does not use halogenated hydrocarbons such as freon.

The present invention is an improvement on a method of setting poles, resetting poles, ground line treatment of poles, encapsulation of pole treatment chemicals or the like with a foam polyurethane composition wherein the improvement comprises the steps of in-situ formation of said composition by combining polyisocyanate, an organic active hydrogen containing component, a liquid water-immiscible component in an amount effective to allow formation of foam with sufficient strength for holding the pole in the presence of water, a catalyst and an non-ionic surfactant. Furthermore, after combining said materials the composition will have a density of about 4 to 5 pounds per cubic feet and a compression of at least about 75 PSI.

The composition of the present invention utilizes conventional materials such as polyisocyanate and reactive resin components, but also includes a water-immiscible component and a catalyst. The water-immiscible component can be any of a large number of materials or even mixtures of materials. Preferably the water-immiscible component is a liquid having a low vapor pressure which is substantially non-reactive under the usual conditions of foam formation with either the resin or the polyisocyanate components used to form the polyurethane composition.

Although materials which react with either or both of the polyurethane components are by no means excluded and may comprise part of the water-immiscible component, non-reactive immiscible components are preferred because of economic reasons. If the water-immiscible component is more reactive than the resin with the polyisocyanate, an increased amount of polyisocyanate is needed for its essential functions of providing carbon dioxide by reaction with water and its solid resin forming function by reaction with the liquid resin. Since polyisocyanate is usually the most costly component of the polyurethane forming system, it is desirable to keep this component at a minimum.

Although not completely essential, another important characteristic of water-immiscible components is that they have low vapor pressures and be relatively non-volitale. Low vapor pressure means that the component has a vapor pressure lower than water at ordinary temperature and usually is a vapor pressure less than 20 mm Hg. In the preferred embodiment the vapor pressure is usually lower than 0 mm Hg at 100° F.

"Water-immiscible" means that the solubility in water at about 70% F is less than about 5 grams per 100 grams of water and preferably less than about 1 gram per 100 grams of water. In a preferred embodiment, the water-immiscible component has no measureable solubility in water. Among the water-immiscible components are those described in U.S. Pat. No. 3,968,657 which is incorporated herein by reference.

The added water-immiscible component necessary to this invention is to be distinguished from the usual essential components of a polyurethane foam system, namely polyisocyanate and resin which are normally water-immiscible in themselves. As indicated above, it is preferred that the water-immiscible component be non-reactive with the essential polyurethane components. Once this preference is satisfied, the ratio of water-immiscible component to the remainder of the polyurethane foam forming composition is not critical. The essential considerations for selecting appropriate proportions are that enough of the water-immiscible component be present to inhibit the reaction with water and that excesses of the water-immiscible component which result in unacceptable deterioration of the physical characteristics of the final foam be avoided.

The Silcon glycolcopolmer can be selected from a variety of products. In the preferred embodiment dimethicone copolyol is used. An example of this is Dow Corning's 190 and 193 surfactants. The chemical formula is:

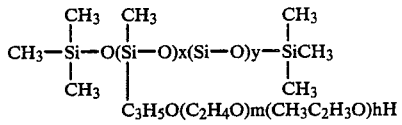

Dow Corning 190 produces less stable foam due to its silicone related characteristics. On the other hand, 193 is water soluble and gives more stable foams. The two can be blended for intermediate effects.

Blowing agents for foam formation are known in the art. However, in the present invention, the improvement is the use of non-halogenated compounds to give a fast foam formation as well as to produce the necessary density and strength. This is a unique improvement.

The petroleum hydrocarbon agent is an Exxon product ESCOPOL A-135, which is a blend of hydrocarbons.

Catalysts are also known in the art and are important in facilitating the foaming reaction. In the preferred embodiment an aminophenol catalyst is used. For example, 2, 4, 6-Tri (demethylaminomethyl) phenol. An important characteristic of a catalyst is the foam formation time sequence. The sequence involves control of the reaction times to regulate the mix of material and the gel process. To maintain the specific strength for complete expansion, the mixing to gel time should be about 28–35 seconds. The rise and skin time should end just before the expansion time is completed. Thus, the rise and skin times end at approximately one hundred forty seconds. The exotherm expansion time starts at about 110 seconds and finishes at about 150 seconds.

It is also known in the art of preparing plastic foams that solid extenders and solid fillers can be advantageously used to reduce cost and achieve desirable characteristics. The use of such fillers and extenders consistent with the obtaining the necessary foam characteristics is contemplated in this invention. Indeed, solid fillers or extenders which serve to reduce corrosion of metals, reduced rotting and termite infestation of wood, can be highly beneficial. On the other hand, fillers and extenders which tend to be corrosive in themselves, are to be avoided. Corrosion problems are often quite complex and depend not only on the exact nature of the metal but also on the precise mechanism of corrosion. Accordingly, the choice of inhibitor will depend on many factors.

EXAMPLE

The foamable compositions utilized in the present invention can vary widely with the requirements mentioned above The following is representative of such formulations in which all parts are by weight.

| | Range | Preferred |
|---|---|---|
| 4, 4' diphenylmethane diisocyanate | 30–50% | 40.2% |
| Petroleum hydrocarbon ESCOPOL A-135 | 5–30% | 18.2% |
| Amine phenolic or polyether polyol | 20–35% | 33% |

-continued

| | Range | Preferred |
|---|---|---|
| or combination of both | | |
| Aromatic Solvent Exxon SC150 | 5–8% | 6.8% |
| Silicone glycolcopolymer | 0–1% | 0.7% |
| Water | 0–1% | 0.8% |
| Aminophenol catalyst | 0–1% | 0.2% |

One skilled in the art will readily appreciate that the present invention is well adapted to carry out the objects and attain the ends and advantages mentioned as well as those inherent therein. Compounds, methods and procedures and techniques described herein are presently representative of the preferred embodiments, are intended to be examples and are not intended as limitations on the scope. Changes therein and other uses will occur to those skilled in art which are encompassed within the spirit of the invention and defined by the scope of the appended claims.

What is claimed is:

1. In the method of setting poles, resetting poles, ground line treatment of poles, encapsulation of pole treatment chemicals or the like with a foamed polyurethane composition wherein the improvement comprises the steps of in-situ formation of said composition by combining polyisocyanate, an organic active hydrogen containing component, a liquid water-immersible component in an amount effective to allow formation of a foam of sufficient strength for holding the pole in the presence of water, a catalyst and a non-ionic surfactant, said composition having a density of about 4–5 pounds per cubic feet and a compression of at least about 75 PSI.

2. The method of claim 1, wherein said composition is formed by combining: about 30–50% 4, 4' diphenylmethane diisocyanate, about 5–30% petroleum hydrocarbon ESCOPOL A-135, about 20–35% of amine phenolic or polyether polyol or combination of both, about 5–8% aromatic solvent Exxon SC150, up to above 1% silicone glycolcopolymer, less than 1% water, and up to about 1% aminophenol catalyst.

3. The method of claim 2, wherein the 4, 4' diphenylmethane diisocyanate is about 40.2%, the petroleum hydrocarbon ESCOPOL A-135 is about 18.2%, the amine phenolic or polyether polyol or combination of both is about 33%, the aromatic solvent Exxon SC150 is about 6.8%, silicone glycolcopolymer is about 0.7%, water is about 0.8%, aminophenol catalyst is about 0.2%.

* * * * *